US008261495B1

(12) United States Patent
Griffin

(10) Patent No.: US 8,261,495 B1
(45) Date of Patent: Sep. 11, 2012

(54) CONNECTOR SYSTEM FOR CONNECTING PANELS OF FRAMING MEMBERS

(76) Inventor: Alphonso Griffin, Chesapeake, VA (US)

( * ) Notice: Subject to any disclaimer, the term of this patent is extended or adjusted under 35 U.S.C. 154(b) by 0 days.

(21) Appl. No.: 13/068,447

(22) Filed: May 11, 2011

Related U.S. Application Data

(60) Provisional application No. 61/400,982, filed on Aug. 5, 2010.

(51) Int. Cl.
*E04B 7/04* (2006.01)

(52) U.S. Cl. ..... 52/92.2; 52/93.1; 52/92.1; 52/647; 52/649.2; 52/655.1; 52/656.9; 52/657; 52/696; 52/278

(58) Field of Classification Search ..... 52/92.2, 52/93.1, 90.1, 92.1, 639, 640, 641, 646, 647, 52/649.2, 655.1, 654.1, 656.9, 693, 657, 52/695, 696, 105, 285.3, 272, 278, 712, 715
See application file for complete search history.

(56) References Cited

U.S. PATENT DOCUMENTS 2,169,474 A * 8/1939 Pederson ..... 52/86
2,272,910 A * 2/1942 Gobberdiel ..... 52/262
3,877,193 A * 4/1975 Hall ..... 52/665
4,713,923 A * 12/1987 Sielaff et al. ..... 52/713
5,950,385 A * 9/1999 Herren ..... 52/481.1
6,240,682 B1 * 6/2001 James et al. ..... 52/90.2
7,021,021 B2 * 4/2006 Saldana ..... 52/696
7,325,362 B1 * 2/2008 Rowland ..... 52/93.2
7,739,841 B1 * 6/2010 Puckett ..... 52/93.1

* cited by examiner

*Primary Examiner* — William Gilbert
*Assistant Examiner* — Chi Q Nguyen
(74) *Attorney, Agent, or Firm* — Peter J. Van Bergen

(57) ABSTRACT

A system for connecting panels of framing members utilizes five types of monolithic, elongate connectors. A first connector has a cross-section defined by an L-shaped portion and a straight portion extending from a bottom tip of the foot of the L-shaped portion at an angle. A second connector has a cross-section defined by an L-shaped portion and a straight portion extending from a top tip of the leg of the L-shaped portion at the same angle as the first connector. A third connector has a cross-section defined by a U-shaped portion and two straight sections extending away from the U-shaped portion. A fourth connector has a cross-section defined by two equal-length straight portions meeting at a right angle, and a fifth connector has a cross-section defined by a single straight portion.

10 Claims, 6 Drawing Sheets

CONNECTOR SYSTEM FOR CONNECTING PANELS OF FRAMING MEMBERS

Pursuant to 35 U.S.C. §119, the benefit of priority from provisional application 61/400,982, with a filing date of Aug. 5, 2010, is claimed for this non-provisional application.

FIELD OF THE INVENTION

The invention relates generally to construction framing systems, and more particularly to a system of connectors used to connect panels of framing members.

BACKGROUND OF THE INVENTION

Frame construction using wood or metal framing members (i.e., studs, top plates, sill plates, bands, rafters, girders, joists, etc.) is well understood in the art. In many cases, prefabricated panels of framing members are manufactured off-site at a factory, transported to a construction site, and assembled with other such panels at the construction site. Typically, panels are joined using fasteners driven through various locations where two or more panels meet. However, this approach frequently results in non-uniform or random use of panel fasteners depending on who is performing the assembly. Furthermore, it is only fasteners themselves that serve to tie the panels together into an ultimate construction. That is, the framing panels are tied together at individual fasteners that create local stress points if/when the structure experiences shock or stress caused the by earthquakes, high winds, etc. Failure of just a few local stress points can lead to substantial structural damage since the failed local stress points provide weak regions that can promote additional failure propagation. Still further, the use of individual and non-uniformly placed fasteners to join framing panels makes any disassembly difficult or impossible if/when a structure's size/configuration is to be changed (e.g., structure additions, changing interior wall configurations, etc.).

SUMMARY OF THE INVENTION

Accordingly, it is an object of the present invention to provide a system for connecting panels of framing members.

Another object of the present invention is to provide a system for connecting panels of framing members that results in improved structural strength.

Still another object of the present invention is to provide a system for connecting framing panels that simplifies the disassembly of connected framing panels.

Other objects and advantages of the present invention will become more obvious hereinafter in the specification and drawings.

In accordance with the present invention, a system for connecting panels of framing members utilizes five types of connectors. Each type of connector is monolithic and elongate. A first connector has a cross-section defined by an L-shaped portion and a straight portion with its straight portion extending from a bottom tip of the foot of the L-shaped portion at an angle. A second connector has a cross-section defined by an L-shaped portion and a straight portion with its straight portion extending from a top tip of the leg of the L-shaped portion at the same angle as the first connector. A third connector has a cross-section defined by (i) a U-shaped portion with a base and opposing legs extending perpendicularly from the base to thereby form a first vertex and a second vertex, (ii) a first straight portion extending away from the U-shaped portion at the first vertex and aligned with one of the opposing legs, and (iii) a second straight portion extending away from the U-shaped portion at said the vertex and aligned with the base. A fourth connector has a cross-section defined by two equal-length straight portions meeting at a right angle, and a fifth connector has a cross-section defined by a single straight portion.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

The present invention is a system of connectors to connect panels of framing members that are to be incorporated into a structure. The ultimate structure can be a residential or non-residential structure without departing from the scope of the present invention. The panels can be used to construct exterior/interior walls, a roof, floors, or ceilings. While the present invention includes five types of connectors, the quantity of each type of connector as well as the total number of connectors used in a structure will vary based on the structure's size and configuration.

Figure 1:
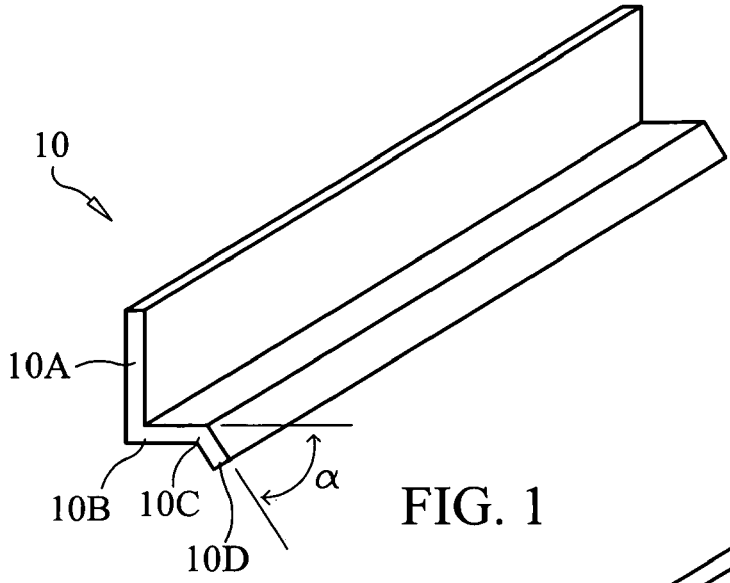
FIG. 1 is a perspective view of a roof ridge connector in accordance with an embodiment of the present invention.
Figure 2:
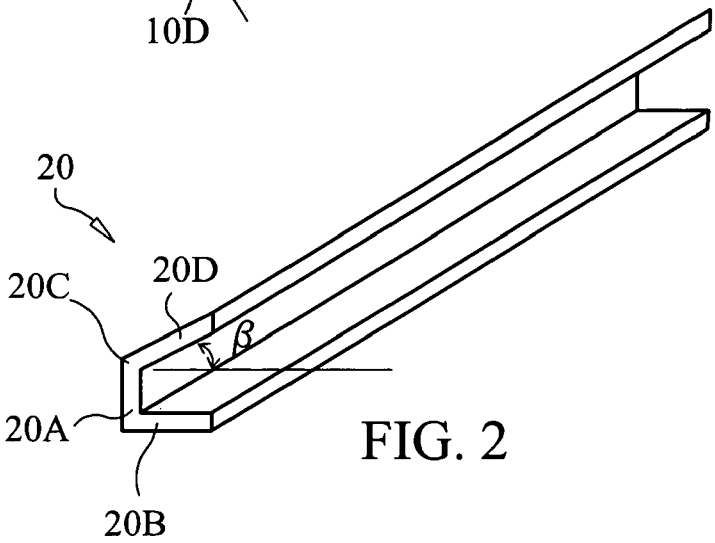
FIG. 2 is a perspective view of a roof panel connector in accordance with an embodiment of the present invention.
Figure 3:
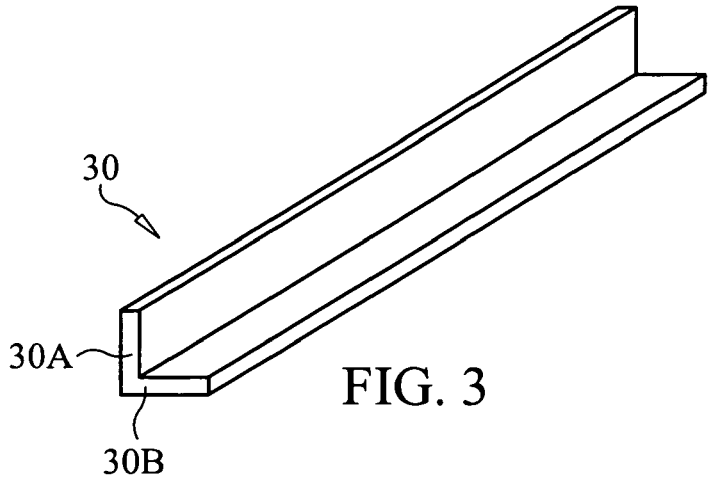
FIG. 3 is a perspective view of a right angle connector in accordance with an embodiment of the present invention.
Figure 4:
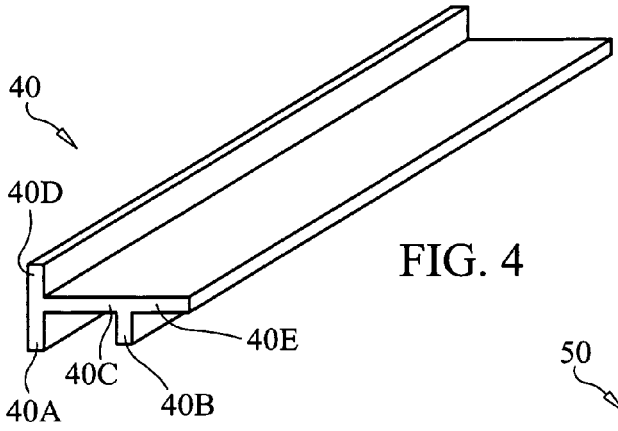
FIG. 4 is a perspective view of a perimeter wall connector in accordance with an embodiment of the present invention.
Figure 5:
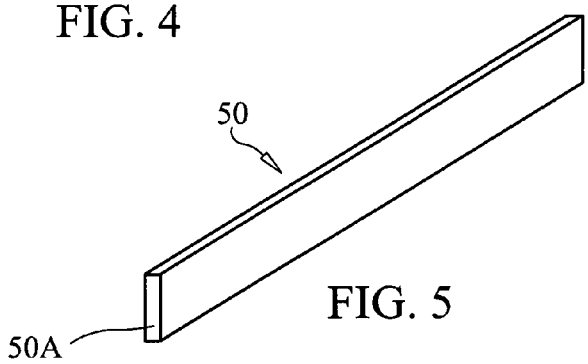
FIG. 5 is a perspective view of a planar connector in accordance with an embodiment of the present invention.

Referring now to the drawings, the five types of connectors comprising the present invention's connector system are shown in isolation in FIGS. 1-5. Following descriptions of the five types of connectors, some exemplary uses of the connectors will be presented. In general, the connectors illustrated in FIGS. 1 and 2 are used in combination to connect roof panels to each other and to other parts of a structure. The connectors illustrated in FIGS. 3-5 are used singly or in various combinations to connect exterior or interior wall panels to each other and to other parts of a structure. Each of the connectors is made from a single piece of material (i.e., is monolithic) that can be made from a metal, plastic or composite without departing from the scope of the present invention. The connectors could be bent or extruded on site and cut to specific lengths for a particular application, or could be manufactured in a factory to pre-determined dimensions without departing from the scope of the present invention.

Referring first to FIG. 1, a roof ridge connector 10 is a one-piece elongate connector having the same cross-section all along its length. More specifically, the cross-section of roof ridge connector 10 is defined by an L-shaped portion formed by a leg 10A and a foot 10B that meet at a right angle. Extending down and away from the outboard tip 10C of foot 10B is a straight section 10D. The angle α that straight section 10D makes with foot 10B is equal to the rake angle of a roof (not shown) that will incorporate roof ridge connector 10 as will be explained later herein.

Referring next to FIG. 2, a roof panel connector 20 is a one-piece elongate connector having the same cross-section all along its length. Specifically, the cross-section of connector 20 is defined by an L-shaped portion formed by a leg 20A and a foot 20B that meet at a right angle. Extending up from outward tip 20C of leg 20A and over foot 20B is a straight section 20D. The angle β that straight section 20D makes with an imaginary plane that is parallel to foot 20B is equal to the rake angle of a roof (not shown) that will incorporate roof panel connector 20 as will be explained later herein. That is, when used in combination with roof ridge connector 10, angle β of connector 20 equals angle α of roof ridge connector 10. The lengths of the leg, foot, and straight section can vary depending on design requirements.

In FIG. 3, a right angle connector 30 is a one-piece elongate connector having the same cross-section all along its length. Specifically, the cross-section of connector 30 is formed by two equal (as shown) or non-equal length straight legs 30A and 30B that meet at a right angle.

Referring now to FIG. 4, a perimeter wall connector 40 is a one-piece elongate connector having the same cross-section all along its length. Specifically, the cross-section of perimeter wall connector 40 is defined by a U-shaped portion formed by opposing legs 40A and 40B joined together by a base 40C where legs 40A/40B meet base 40C at right angles. A straight section 40D extends away from leg 40A at the vertex formed by the intersection of leg 40A and base 40C. Straight section 40D is aligned with leg 40A such that the combination of leg 40A and straight section 40D forms a straight section. Another straight section 40E extends away from base 40C at the vertex formed by the intersection of leg 40B and base 40C. Straight section 40E is aligned with base 40C such that the combination of base 40C and straight section 40E forms a straight section. The lengths of the various legs, base, and straight sections can vary depending on design requirements. Incorporation of perimeter wall connector 40 into an exterior or perimeter wall structure will be explained later herein.

FIG. 5 illustrates a planar connector 50 that is a one-piece elongate connector having the same cross-section all along its length. The cross-section is simply a straight section 50A such that connector 50 is an elongate flat plate or strip, the use of which will be explained later herein.

As mentioned above, connectors 10-50 can be used in a variety of combinations depending on the configuration of a particular structure. By way of example, several portions of structures will be described with the aid of FIGS. 6-11 in order to illustrate the use of the five types of connectors described above. The relative thickness of the walls of the connectors has been exaggerated for purpose of illustration. Further, the drawings only illustrate those framing elements that interface with the connectors.

Figure 6:
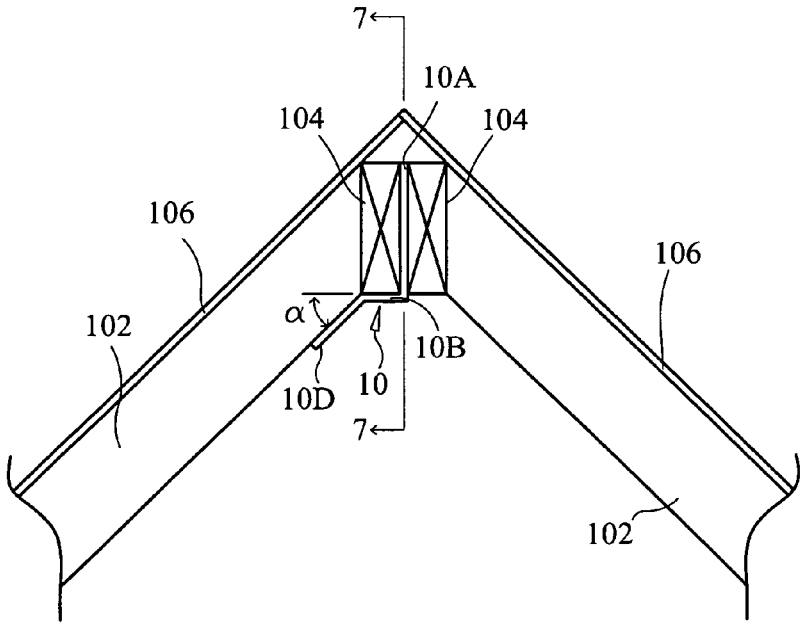
FIG. 6 is an end view of the ridge portion of a roof incorporating a roof ridge connector in accordance with an embodiment of the present invention.
Figure 7:
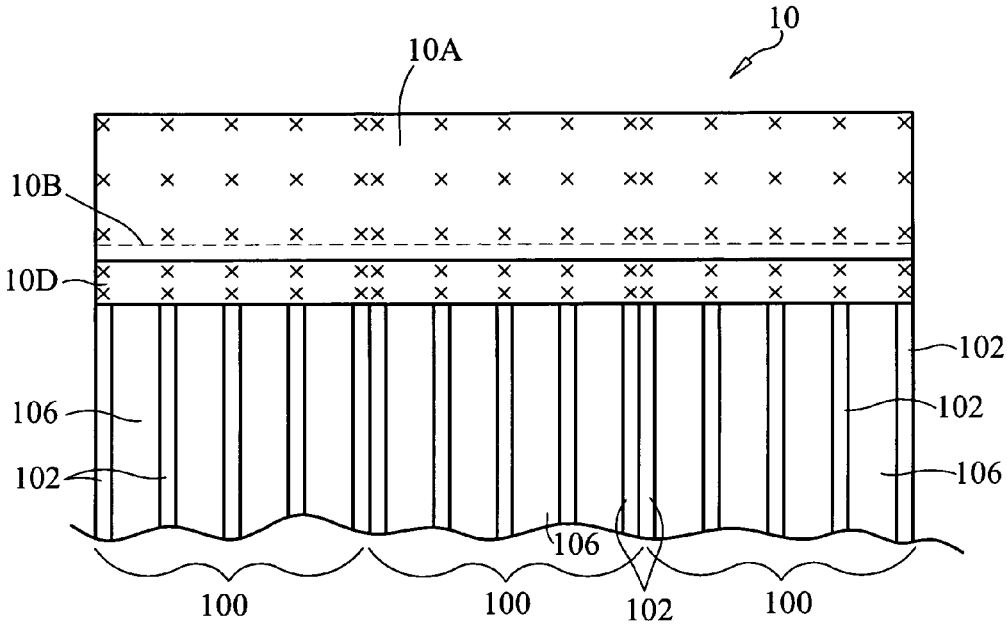
FIG. 7 is a view of the ridge portion of the roof taken along line 7-7 in FIG. 6 where the roof ridge connector spans three roof panels.

Referring first to FIGS. 6 and 7, the ridge portion of a roof incorporating a roof ridge connector 10 is illustrated. The roof is made from roof panels 100 where each panel 100 includes (at the ridge portion thereof) rafters 102, a ridge tie 104, and roof sheathing 106. In the illustrated example, roof ridge connector 10 spans/connects three roof panels 100 as illustrated in FIG. 7. While the number of raters per panel and the number of panels spanned/connected by connector 10 are not limitations of the present invention, a typical panel could span the length of conventional sheathing (e.g., 8 feet) and rafters 102 could be spaced using, for example, 16 or 24 inch "on center" spacing. Roof ridge connector 10 is sized to nest with the ridge tie 104 of each panel 100. That is, the length of leg 10A is commensurate with the width dimension of ridge tie 104 while the length of foot 10B is commensurate with the thickness dimension of ridge tie 104. The angle α of straight section 10D is commensurate with the rake angle of roof panel 100 such that straight section 10D lies against each rafter 102 at the thickness dimension thereof as illustrated.

With roof ridge connector 10 placed as illustrated and described, connector 10 is fastened at multiple locations to the spanned panels 100 along one side of the roof thereby aligning and joining them together. Required and/or preferred fastener locations can be marked (e.g., printed, scored, "punched out", etc.) on connector 10 as illustrated by "x" in FIG. 7. The number and placements of fastener locations can be predetermined or pre-engineered for maximum strength. Panels 100 forming the other side of the roof are then fastened along connector 10. In this way, a single monolithic connector 10 is used to tie a number of roof panels together for overall structural strength.

Figure 8:
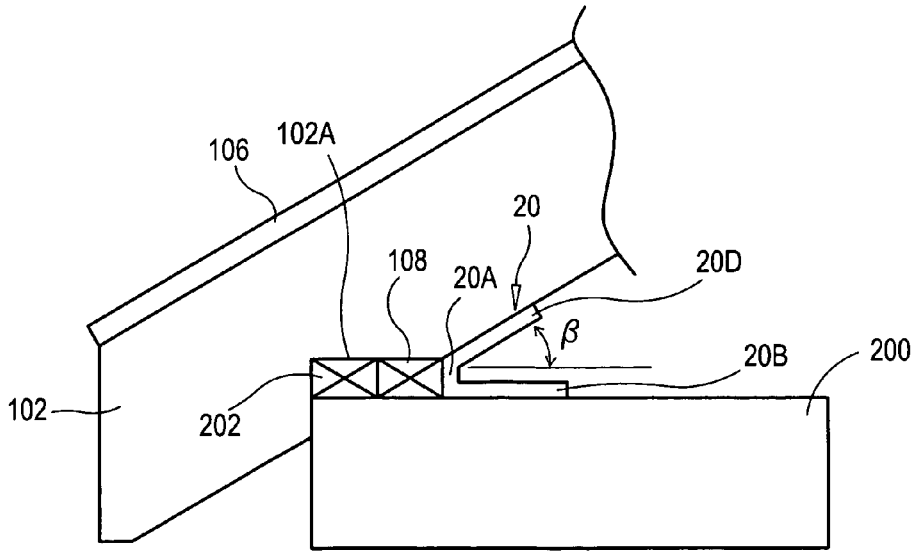
FIG. 8 is an end view of the lower portion of a roof incorporating a roof panel connector in accordance with an embodiment of the present invention.

The lower ends of roof panels on each side of roof are similarly joined together using a roof panel connector 20 as illustrated in FIG. 8. As is well known in the art of frame construction the lower portion of each rafter 102 (only one is shown in FIG. 8) is notched with a bird's mouth 102A. A key board 108 rests in each bird's mouth 102A and spans the width of roof panel. Key board 108 is attached to each rafter 102 in a roof panel thereby completing the construction of a roof panel. This lower portion of a roof panel rests on a ceiling joist system that includes ceiling joists 200 (only one is visible in FIG. 8) and a plate 202 spanning multiple ceiling joists 200 where plate 202 fits in bird's mouth 102A adjacent keyboard 108. Roof panel connector 20 is positioned such that its leg 20A is adjacent to keyboard 108, its foot 20B rests on ceiling joist 200, and its straight section 20D rests against the underside of rafters 102 since its angle β is equal to the rake angle of the roof panel. It is to be understood that connector 20 spans and connects the lower portions of multiple roof panels just like connector 10. Similar to connector 10, predetermined or pre-engineered fastener locations (not shown) can be provided on connector 20. The monolithic nature of connector 20 joins/links the lower portions of multiple roof panels and joins/links them to a ceiling joist system.

Figure 9:
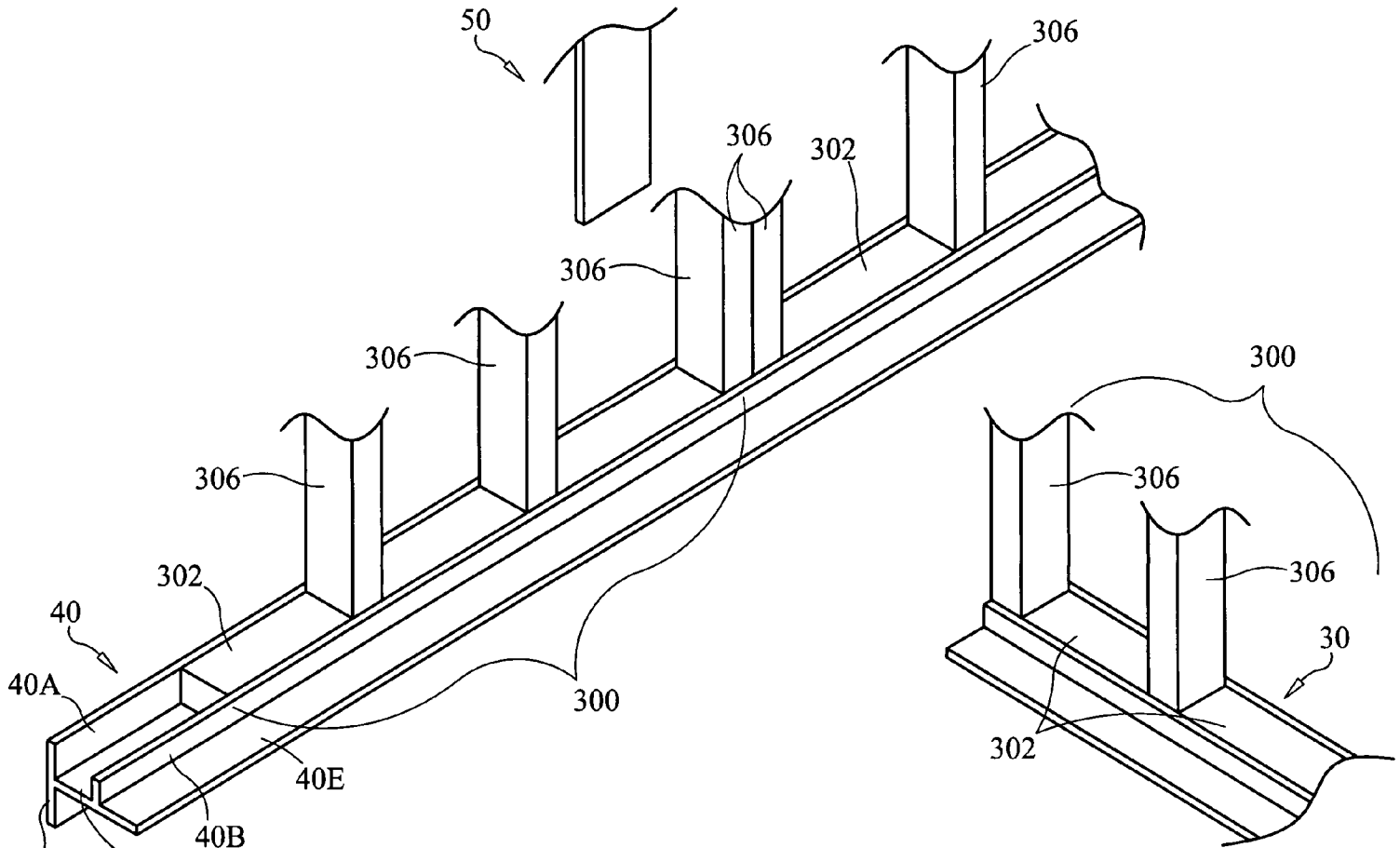
FIG. 9 is an exploded view of two exterior wall panels and an interior wall panel along with perimeter wall connectors, right angle connectors and a planar connector in accordance with an embodiment of the present invention.
Figure 10:
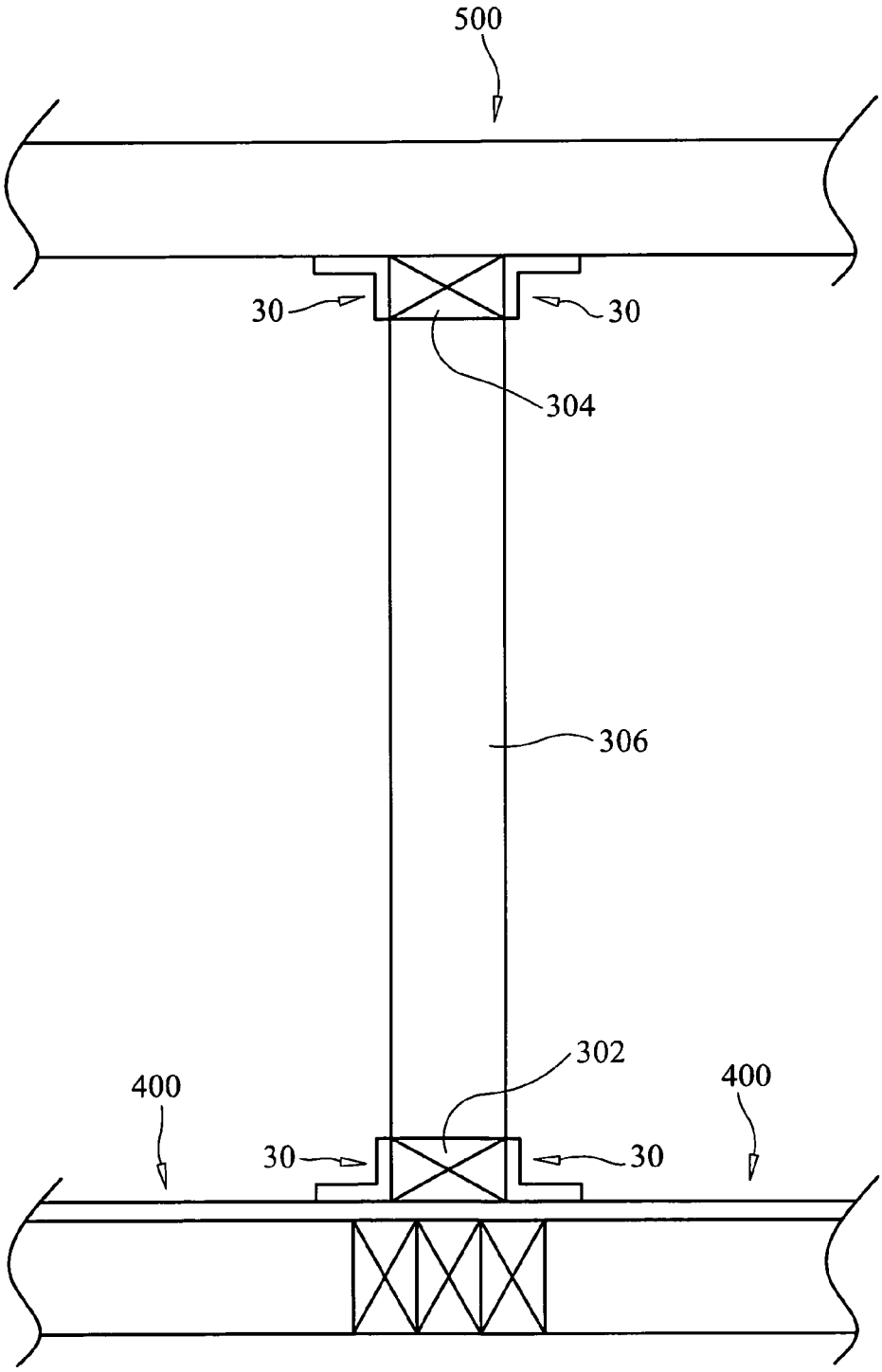
FIG. 10 is an end view of an interior wall panel and the right angle connectors used therewith.
Figure 11:
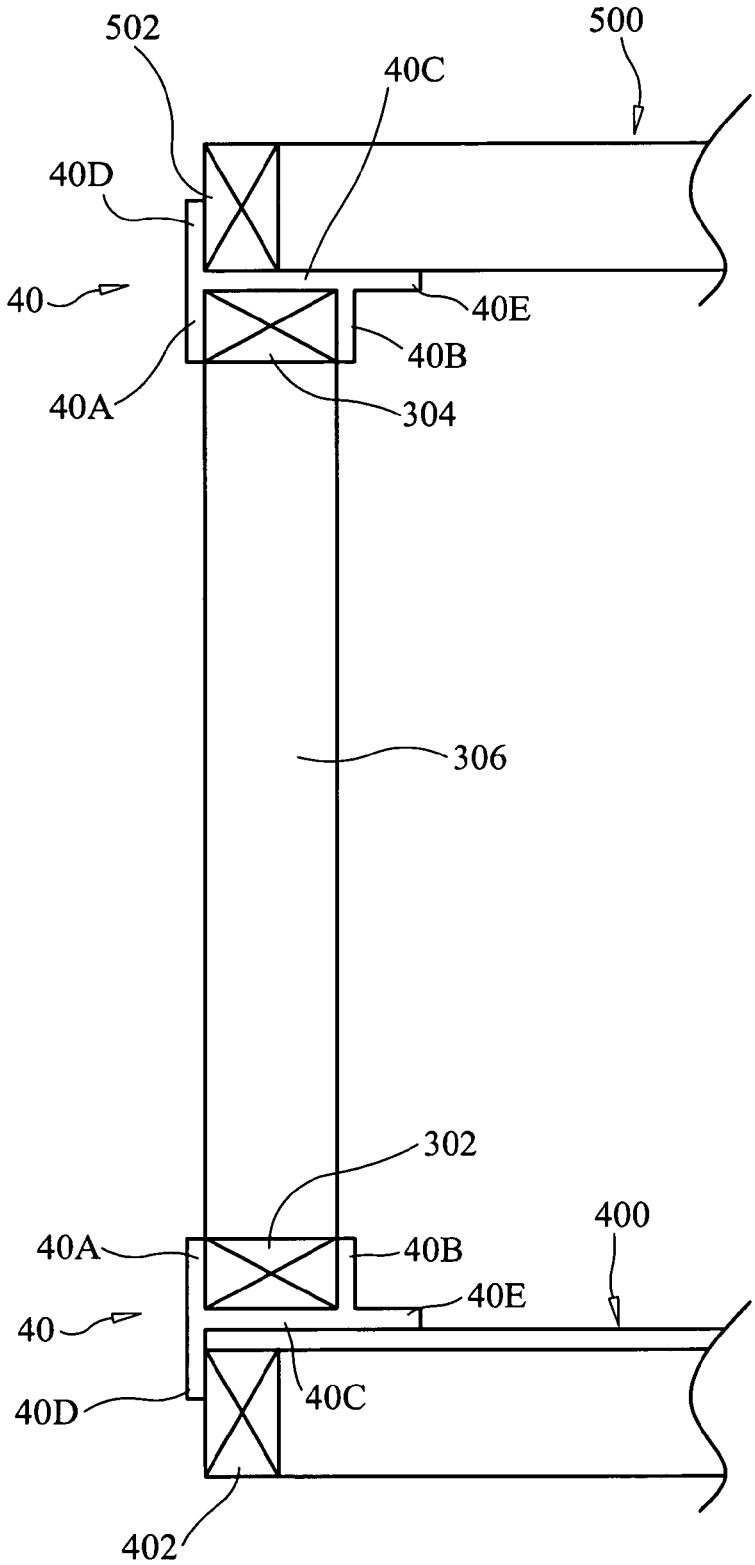
FIG. 11 is an end view of an exterior wall panel and the perimeter wall connectors used therewith.

Referring now to FIGS. 9-11, exemplary uses of connectors 30, 40, and 50 will be explained. For clarity of illustration in FIG. 9, connectors 30 and 40 are only shown at the lower portions of wall panels 300. In addition, only the sill plate 302 of each wall panel 300 is shown. However, as would be understood in the art, a top plate 304 would also be included in a wall panel 300 as illustrated in each of FIGS. 10 and 11. Each wall panel 300 also includes studs 306 between sill plate 302 and top plate 304 with all such framing members of a panel 300 being fastened together as would be understood in the art. The size of each wall panel and number of studs used in each wall panel are not limitations of the present invention.

Although each wall panel 300 only illustrates studs 306, it is to be understood that a wall panel could include window and/or door framing.

With respect to wall panels 300 that are to form interior walls of a structure, right angle connectors 30 are positioned alongside opposing edges of both sill plate 302 and top plate 304 as shown in FIG. 10. One straight leg of each connector 30 rests against and is fastened to one side of either plate 302 or 304, while the other straight leg of each connector 30 rests against and is fastened to a floor panel 400 or a ceiling panel 500 of the structure. (Note that floors and ceilings of a structure could be constructed as panels similar to the roof and wall panels described above.) Similar to the previously-described connectors, connectors 30 can include markings indicating required or preferred positioning of fasteners. Each connector 30 is manufactured or cut to a length of a wall so that multiple wall panels 300 can be joined by monolithic connectors 30 that extend all along the length of the finished wall.

With respect to wall panels that are to form exterior walls of a structure, perimeter wall connectors 40 are positioned below sill plate 302 and above top plate 304. More specifically, the U-shaped portion defined by legs 40A/40B and base 40C is sized to have the width and thickness dimensions of sill plate 302 and top plate 304 nest therein as illustrated in FIG. 11. At the floor, straight section 40D rests against and is fastened to an outer floor joist 402 of a floor panel 400. Straight section 40E rests against and is fastened to floor panel 400. At the ceiling, straight section 40D rests against and is fastened to an outer ceiling joist 502 of a ceiling panel 500, while straight section 40E is fastened to the underside of a ceiling panel 500. Similar to the connectors described above, perimeter wall connectors 40 can include markings indicating required or preferred positioning of fasteners. Each connector 40 is manufactured or cut to the full length of an exterior wall so that multiple wall panels 300 can be joined by monolithic connectors 40 that extend all along the length of the finished wall. Furthermore, the configuration of connectors 40 allows the tops and bottoms of wall panels to be monolithically joined to a ceiling and floor, respectively, of the structure.

Planar connector 50 can be used in a variety of ways in conjunction with other connectors of the present invention. For example, FIG. 9 illustrates the use of planar connector 50 when an interior wall is to abut an exterior wall. In this instance, two vertical studs 306 from aligned and abutting exterior wall panels 300 are tied together monolithically using connector 50 when it is fastened thereto. (Although not shown in FIG. 9, right angle connectors 30 could be positioned/fastened vertically along the right angles formed on either side of the interior wall where it abuts the exterior wall.) Once again, connectors 50 can be marked for required or preferred fastening patterns. These patterns could be different depending on the connector's use. Further, connectors 50 could include multiple markings to cover multiple uses.

The advantages of the present invention are numerous. The monolithic connector will join multiple roof and/or wall panels together and to a floor and ceiling system to form a stronger structure. The connectors will allow a construction system to utilize small framing panels to simplify construction, handling, shipping, etc. The connectors can be readily sized to predetermined lengths or extruded on a job site to custom lengths. The disassembly of roof and/or wall panels is facilitated thereby allowing for simple modification or expansion as these needs arise.

Although the invention has been described relative to a specific embodiment thereof, there are numerous variations and modifications that will be readily apparent to those skilled in the art in light of the above teachings. For example, the connectors can also be used in various combinations to construct pre-engineered modules designed to support various systems (e.g., plumbing, HVAC, electrical, etc.) that are typically incorporated into framed structures. It is therefore to be understood that, within the scope of the appended claims, the invention may be practiced other than as specifically described.

What is claimed as new and desired to be secured by Letters Patent of the United States is:

1. A system for connecting panels of framing members, comprising:

at least one pair of roofing connectors couple multiple roof panels of framing members in a serial fashion to form a roof of a structure with each of the roof panels configured for a rake angle and with each of the roof panels including a plurality of rafters coupled on first ends thereof by a ridge plate and coupled near second ends thereof by a key board fitted in a bird mouth cut in each of the rafters, each said pair of roofing connectors including a first connector couple the roof panels at the ridge plates thereof and a second connector couple the roof panels at positions adjacent the bird mouths of the rafters thereof, said first connector being monolithic and elongate with a cross-section thereof defined by an L-shaped portion and a straight portion extending from a bottom tip of a foot of said first connector L-shaped portion at an angle matched to the rake angle of the roof panels, said second connector being monolithic and elongate with a cross-section thereof defined by an L-shaped portion and a straight portion extending from a top tip of a leg of said second connector L-shaped portion at an angle matched to the rake angle of the roof panels;

at least one exterior wall connector coupled wall panels of framing members in a serial fashion to form an exterior wall of the structure with each of the wall panels including a plurality of studs coupled on first ends thereof to a top plate and coupled on opposing ends thereof to a sill plate, each said exterior wall connector being monolithic and elongate with a cross-section thereof defined by (i) a U-shaped portion having a base and opposing legs extending perpendicularly from said base, (ii) a first straight portion extending from one side of said U-shaped portion and aligned with one of said opposing legs, and (iii) a second straight portion extending from an opposing side of said U-shaped portion and aligned with said base;

at least one right angle connector coupled ones of the wall panels in a serial fashion to form an interior wall of the structure, each said right angle connector being monolithic and elongate with a cross-section thereof defined by two straight portions meeting at a right angle; and at least one planar connector coupled ones of the wall panels that meet at right angles to one another, each said planar connector being a monolithic and elongate flat plate.

2. A system as in claim 1, wherein said first connector L-shaped portion is sized for nested engagement with portions of the ridge plates.

3. A system as in claim 1, wherein said exterior wall connector U-shaped portion is sized for nested engagement with a portion of one of the sill plate and top plate.

4. A system as in claim 1, wherein each of said roofing connectors, said exterior wall connector, said right angle connector, and said planar connector are made from a material selected from the group consisting of metals, plastics, and composites.

5. A system as in claim 4, wherein said material comprises one of an extruded material and a bent material.

6. A system as in claim 1, further comprising pre-marked fastener locations on at least one of said roofing connectors, said exterior wall connector, said right angle connector, and said planar connector.

7. A system for connecting panels of framing members comprising:

five types of connectors, each of said five types being monolithic and elongate, said five types consisting of a first connector having a cross-section defined by an L-shaped portion and a straight portion with said first connector L-shaped portion having a leg and a foot meeting at a right angle and with said first connector straight portion extending from a bottom tip of said foot of said first connector L-shaped portion at an angle, said first connector L-shaped portion receiving therein the cross-sectional dimensions of a roof ridge plate with said angle being adapted to match the roof rake angle, a second connector having a cross-section defined by an L-shaped portion and a straight portion with said second connector L-shaped portion having a leg and a foot meeting at a right angle and with said second connector straight portion extending from a top tip of said leg of said second connector L-shaped portion at said angle, said second connector straight portion coupled to the roof rafters adjacent to a key board on which the rafters rest, a third connector having a cross-section defined by (i) a U-shaped portion with a base and opposing legs extending perpendicularly from said base to thereby form a first vertex and a second vertex, said U-shaped portion adapted to receive therein the cross-sectional dimensions of one of a wall top plate and sill plate, (ii) a first straight portion extending away from said U-shaped portion at said first vertex and aligned with one of said opposing legs, and (iii) a second straight portion extending away from said U-shaped portion at said second vertex and aligned with said base, a fourth connector having a cross-section defined by two straight portions meeting at a right angle, said fourth connector coupled to one of said wall top plate and sill plate; and a fifth connector having a cross-section defined by a single straight portion; said fifth connector coupling one of said wall to another said wall positioned at right angle thereto.

8. A system as in claim 7, wherein each of said five types of connectors is made from a material selected from the group consisting of metals, plastics, and composites.

9. A system as in claim 7, wherein said material comprises one of an extruded material and a bent material.

10. A system as in claim 7, further comprising pre-marked fastener locations on at least one of said five types of connectors.

* * * * *